US005967367A

United States Patent [19]

Orsborn

[11] Patent Number: 5,967,367

[45] Date of Patent: Oct. 19, 1999

[54] DRINKS-DISPENSING APPARATUS

[75] Inventor: Brian Joseph Orsborn, London, United Kingdom

[73] Assignee: Coca-Cola & Schweppes Beverages Limited, Uxbridge, United Kingdom

[21] Appl. No.: 08/983,110

[22] PCT Filed: Jul. 8, 1996

[86] PCT No.: PCT/GB96/01615

§ 371 Date: Apr. 20, 1998

§ 102(e) Date: Apr. 20, 1998

[87] PCT Pub. No.: WO97/03916

PCT Pub. Date: Feb. 6, 1997

[30] Foreign Application Priority Data

Jul. 17, 1995 [GB] United Kingdom ..... 9514592

[51] Int. Cl.[6] ..... B67D 5/56

[52] U.S. Cl. ..... 222/30; 222/37; 222/23; 222/129.1; 222/641

[58] Field of Search ..... 222/23, 30, 36, 222/37, 129.1, 129.2, 129.4, 640, 641

[56] References Cited

U.S. PATENT DOCUMENTS

| | | | |
|---|---|---|---|
| 2,037,688 | 4/1936 | Brady | 222/129.4 X |
| 2,838,077 | 6/1958 | Cooper | 222/640 X |
| 3,685,692 | 8/1972 | Erne et al. | 222/23 |
| 4,487,333 | 12/1984 | Pounder et al. | 222/54 |
| 4,800,492 | 1/1989 | Johnson et al. | 364/403 |
| 4,821,925 | 4/1989 | Wiley et al. | 222/129.4 |
| 4,827,426 | 5/1989 | Patton et al. | 364/479 |
| 4,946,073 | 8/1990 | Brill et al. | 222/129.4 |
| 4,979,639 | 12/1990 | Hoover et al. | 222/129.1 X |
| 5,027,284 | 6/1991 | Senghaas et al. | 364/479 |
| 5,102,011 | 4/1992 | Whigham et al. | 222/129.4 X |
| 5,230,448 | 7/1993 | Strohmeyer et al. | 222/643 |

FOREIGN PATENT DOCUMENTS

| | | |
|---|---|---|
| 0530858 | 3/1993 | European Pat. Off. . |
| WO9208671 | 5/1992 | WIPO . |
| WO9404286 | 3/1994 | WIPO . |

*Primary Examiner*—Kenneth Bomberg
*Attorney, Agent, or Firm*—Christie, Parker & Hale, LLP

[57] ABSTRACT

A multi-head drinks-dispensing apparatus having a group of drinks-dispensing heads each arranged for supply with drink ingredients through fluid control valves. A keypad has a first group of keys for selecting the type of drink and the dispensing head to be used, and a second group of keys for selecting the quantity of drink to be dispensed. Signals from those groups of keys are processed in a micro-processor, which energizes the relevant pair of valves to commence delivery of the selected drink without any delay. Dispensing of the selected drink is initiated at the earliest moment, while other drinks are being selected, so that selected drinks can be dispensed from the dispensing heads in a serial, overlapping manner. This facilitates the dispensing of a customer's multi-drink order in the shortest possible time. The processor stores data concerning the various drinks that are dispensed in a non-volatile memory, and this data can be transferred to a data collection unit via an infrared link, and then to a drinks management system.

13 Claims, 1 Drawing Sheet

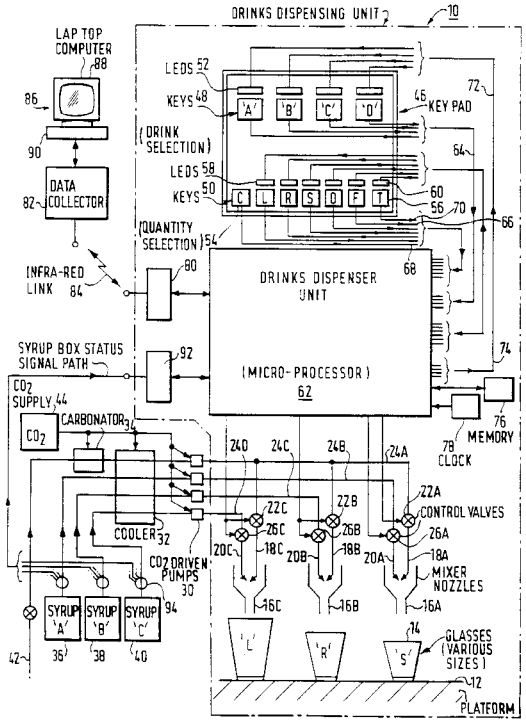

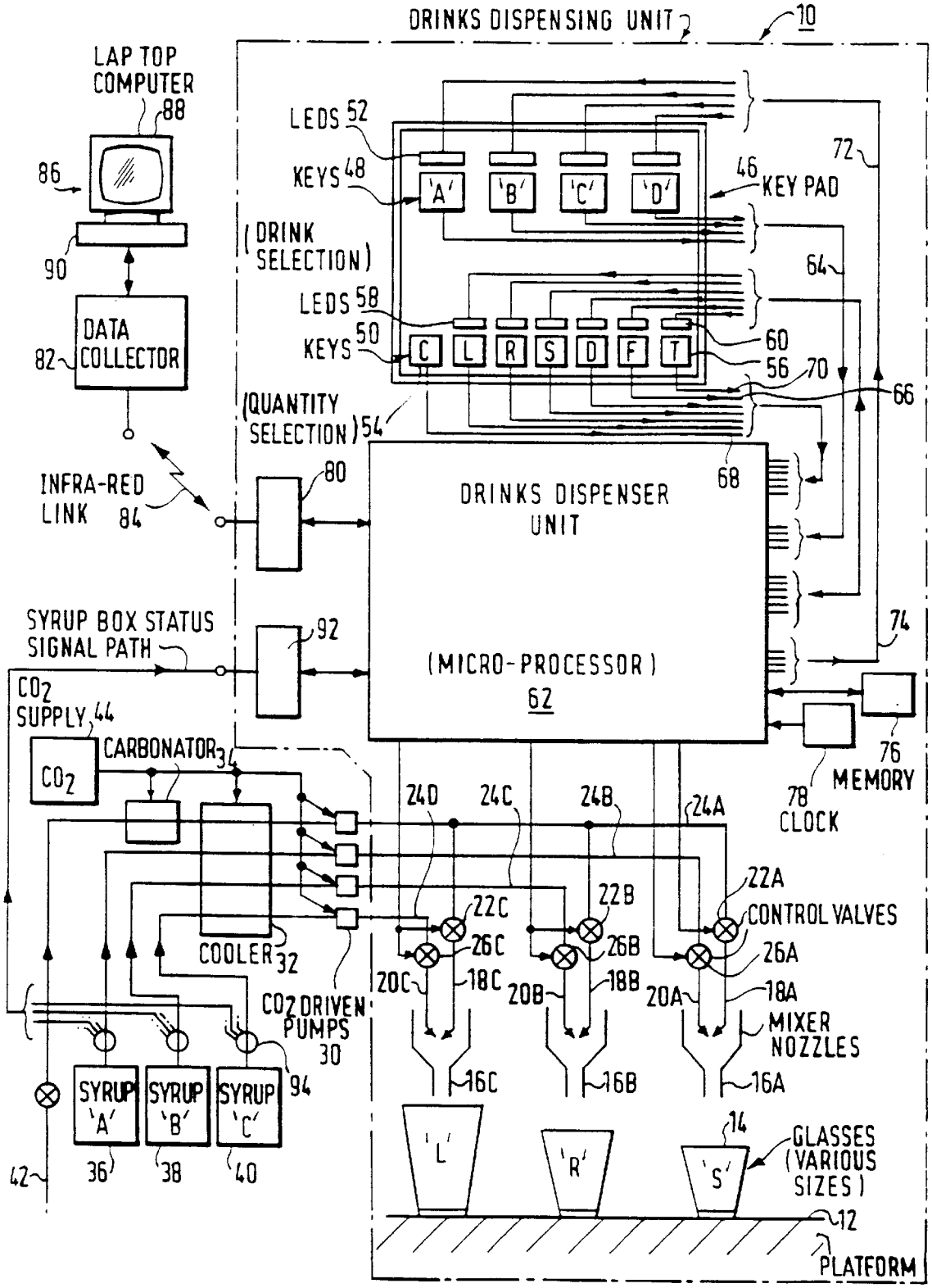
DRINKS DISPENSING UNIT
10
LAP TOP COMPUTER
88
86
90
DATA COLLECTOR
82
LEDS 52
KEYS 48
'A'
'B'
'C'
'D'
46
KEY PAD
72
(DRINK SELECTION)
64
LEDS 58
KEYS 50
C
L
R
S
D
F
T
60
56
70
66
(QUANTITY SELECTION) 54
68
INFRA-RED LINK 84
80
DRINKS DISPENSER UNIT
(MICRO-PROCESSOR)
62
SYRUP BOX STATUS SIGNAL PATH
92
74
CO2 SUPPLY 44
CO2
CARBONATOR 34
76 MEMORY
78 CLOCK
24D
24C
24B
24A
22A
22B
22C
CONTROL VALVES
26C
26B
26A
COOLER 32
20C
18C
20B
18B
20A
18A
CO2 DRIVEN PUMPS 30
MIXER NOZZLES
SYRUP 'A'
SYRUP 'B'
SYRUP 'C'
94
16C
16B
16A
42
36
38
40
'L'
'R'
'S'
14
GLASSES (VARIOUS SIZES)
12
PLATFORM

DRINKS-DISPENSING APPARATUS

BACKGROUND OF THE INVENTION

This invention relates drinks-dispensing apparatus.

Such apparatus commonly includes for each kind of drink to be dispensed (a) a dispensing head which includes a nozzle for feeding the drink into a cup placed below the nozzle, and associated control valves for controlling the flow of drink ingredients under pressure from supply lines to the nozzle for mixing there and delivery into a waiting cup, (b) manually-operable electrical selection means for selecting the quantity of drink to be delivered to the cup, and (c) an electrical control module responsive to an output signal of the selection means and arranged to energise in response thereto the control valves for a period sufficient to deliver the selected quantity of drink through the nozzle into the waiting cup.

A plurality of such dispensing heads may be arranged in a common drink dispensing unit, each such head being arranged to deliver a particular drink different from those to be delivered by the other dispensing heads, and each head being controlled independently of the other heads by its own dedicated selection means and control module. By way of example, a known drinks-dispensing unit includes three such dispensing heads, dispenses three different drinks, and includes three separate spaced-apart selection means and their associated control modules. The three different drinks may comprise a brand of cola, a brand of low calorie 'diet' cola, and a brand of lemonade.

In such a dispensing unit, the dispensing of drinks from the respective heads takes place in a serial, non-overlapping and hence time-consuming manner, which is less convenient for handling customers' multi-drink orders, such as are presented in cinemas, theatres and concert halls in the intervals between successive parts of a performance.

SUMMARY OF THE INVENTION

The present invention seeks to provide a multiple-head drinks-dispensing unit which in response to a multi-drink order is simpler and quicker to operate, requires less time to dispense the required drinks, and requires less electrical selection and control hardware to be accommodated in the dispensing unit.

The present invention also seeks to provide means whereby the operation of each of the dispensing heads can be continuously monitored and its operations reported from time to time to a drinks management system.

The present invention thus concerns a multi-head drinks-dispensing apparatus which comprises a plurality of drink dispensing heads each arranged to deliver a particular drink different from that to be delivered by each other dispensing head, and in which each dispensing head comprises (i) a nozzle for feeding the drink into a cup placed below the nozzle, and (ii) associated control valve means for controlling the flow of drink ingredients under pressure from ingredient supply means to the nozzle for mixing there and delivery into a waiting cup.

According to the present invention, there is provided in such an apparatus (a) first selection means for selecting a drink to be dispensed and thus the dispensing head to be used, (b) a second selection means for selecting the quantity of drink to be delivered by that dispensing head, said first and second selection means being arranged to emit respective first and second selection signals representative of the selected drink and selected drink quantity, (c) memory means for storing at least temporarily each pair of associated first and second selection signals, and (d) logic circuit means arranged to receive said pairs of associated first and second selection signals and in response to each such pair of signals to provide a valve control signal for effecting energisation of the control valve means of the selected dispensing head for a period sufficient to deliver the selected quantity of the selected drink, whereby two or more drinks may be dispensed simultaneously in a serial but over-lapping time relationship.

Thus, the time taken to dispense a customer's multiple drink order is substantially reduced as compared with that of the prior art unit referred to above.

Preferably, supply means for supplying the respective drink ingredients to the respective control valve means are arranged to supply those ingredients at predetermined constant flow rates, and the logic circuit in response to a said second selection signal determines the time period during which the relevant control valve means shall be energised and deliver the relevant drink ingredients to the associated nozzle.

According to one preferred feature of the present invention, there is provided in at least one supply line extending between a drink ingredient supply means and the associated control valve means a monitoring means for monitoring the presence of drink ingredients in that supply line, the monitoring means being arranged to emit an 'ingredient failure' warning signal when there is insufficient drink ingredient in the monitored supply line.

According to another preferred feature of the present invention, there is provided in at least one supply line extending between a drink ingredient supply means and the associated control valve means a supply line monitoring means for monitoring the integrity of that supply line, the monitoring means being arranged to emit a 'supply line tampered' warning signal when that supply line has been interrupted, or otherwise tampered with.

According to further preferred feature of the present invention, there is provided in at least one supply line extending between a drink ingredient supply means and the associated control valve means a monitoring means for monitoring the quality of a drink ingredient in that supply line, the monitoring means being arranged to emit a 'quality failure' warning signal when the quality of the ingredient in the monitored supply line falls below a required standard.

Preferably, a multi-head drinks-dispensing apparatus according to the present invention includes means responsive to said first selection signals and to said 'ingredient failure' warning signals, and is arranged to emit an 'inhibit' signal whenever a first selection signal and an 'ingredient failure' signal are present simultaneously.

Furthermore, such an apparatus preferably includes means responsive to said first selection signals and to said 'supply line tampered' warning signals, and to emit an 'inhibit' signal whenever a first selection signal and a 'supply line tampered' signal are present simultaneously.

In addition, such an apparatus preferably includes means responsive to said first selection signals and to said 'quality failure' warning signals, and to emit an 'inhibit' signal whenever a first selection signal and a 'quality failure' signal are present simultaneously.

Preferably, said memory means retains in storage each such pair of associated first and second selection signals, and stores in association therewith any such inhibit signal emitted pursuant to that pair of selection signals, thereby to indicate that there has been a failure to properly dispense a selected drink.

There may also be provided means for totalling the selected drinks in response to the emission of each such first selection signal, in which means the total is not increased in response to a first selection signal when that signal is accompanied by an inhibit signal.

Alternatively, there may be provided means for totalling the selected drinks in response to the emission of each such second selection signal, in which means the total is not increased in response to a second selection signal when that signal is accompanied by an inhibit signal.

Preferably, there is also provided a 'real time' timing device for recording the day-and or time at which a drink has been selected.

In a preferred embodiment of the present invention, the logic circuit means comprises a suitably programmed micro-processor.

The present invention also extends to the provision of apparatus for converting an existing multi-head drinks-dispensing apparatus into an apparatus according to the present invention.

Other features of the present invention will appear from a reading of the description that follows hereafter and from a reading of the claims that are appended at the end of the description.

One multi-head drinks-dispensing apparatus and various modifications thereof, all according to the present invention, will now be described by way of example and with reference to the accompanying diagrammatic drawing, in which there is shown schematically the principal components of the apparatus and their various electric and fluid inter-connections.

DESCRIPTION OF THE DRAWING

FIG. 1 is a schematic illustration of the drinks-dispensing unit of the present invention.

DETAILED DESCRIPTION OF THE INVENTION

Referring now to the drawing, a drinks-dispensing unit 10 comprises a platform 12 on which drinking cups or glasses 14 of various sizes may be stood beneath three nozzles 16A, 16B, 16C through which respective drinks may be delivered into those glasses.

Each nozzle has two fluid delivery pipes 18(A,B,C) and 20(A,B,C) for delivering and mixing within the nozzle the respective ingredients of the selected drink. Those ingredients comprise cooled carbonated water and a smaller quantity of the relevant cooled syrup.

Pipe 18A delivers to nozzle 16A cooled, pressurised, carbonated water received through a control valve 22A from a supply line 24A. Pipe 20A delivers to nozzle 16A a cooled, pressurised syrup through control valve 26A from a supply line 24B.

Likewise, pipes 18B, 18C deliver to nozzles 16B and 16C cooled, pressurised, carbonated water received through control valves 22B and 22C from the supply line 24A; and pipes 20B, 20C deliver to nozzles 16B and 16C respective cooled, pressurised, syrups through respective control valves 26B and 26C from respective supply lines 24C and 24D.

The respective supply lines 24(A,B,C,D) receive their respective fluids from pumps 30(A,B,C,D) which draw their supplies through a cooler 32 respectively from a carbonator 34, a brand 'A' syrup supply box 36, a brand 'B' syrup supply box 38, and a brand 'C' syrup supply box 40.

The carbonator 34 draws its supply of water from a water supply main 42, and its supply of carbon dioxide from a CO2 cylinder 44. That cylinder also supplies CO2 as the driving fluid to the pumps 30.

The drinks-dispensing unit 10 also includes above the nozzles 16 a tactile membrane keypad 46 which incorporates a group of keys 48 for selecting a drink to be dispensed, and a second group of keys 50 for selecting the quantity (or portion) of the selected drink to be dispensed. Touching one of the keys 48(A,B,C) selects the appropriate one of the syrup brands ('A', 'B', 'C') to be mixed with carbonated water to provide the selected drink, whilst touching the key 48D selects carbonated water alone.

Brand 'A' syrup may comprise, for example, 'COCA COLA' (RTM) syrup; Brand 'B' may comprise, for example, 'DIET COKE' (RTM) syrup; and Brand 'C' may comprise a suitable lemonade syrup.

Disposed above the keys 48 are LED (light emitting diode) indicators 52 which become illuminated to indicate the drinks that have been selected by operation of those keys.

Touching one of the keys 50(A,B,C,D,E) selects the appropriate quantity of the selected drink which is to be dispensed. The respective keys select as desired a large, a regular or a small size of drink, or a dash of syrup only, or a free-flow of carbonated water.

Additional keys on the keypad comprise a CANCEL key 54 for cancelling a selection just entered, and a TEACH key 56 for enabling the system to learn by example what is required in response to the selections made on the 'quantity' selection keys 50.

Disposed above the keys 50 are LED (light emitting diode) indicators 58 which become illuminated to indicate the quantities that have been selected by operation of those keys.

A further LED indicator 60 is provided above the TEACH key 56, to indicate when the apparatus is in the TEACH mode.

The 'drink' and 'quantity' selections made by means of the keypad 46 are translated into command signals for the respective valves 22 and 26 by means of a logic circuit in the form of a micro-processor 62, which receives from the keypad 'drink' selection signals via lines 64 and 'quantity' selection signals via lines 66. The processor also receives appropriate signals from the 'cancel' and 'teach' keys via lines 68,70 to cause it as appropriate to cancel a selection just made, or to cause it to function in the TEACH mode.

The processor 62 emits indication signals via lines 72 and 74 to cause illumination of the appropriate ones of the LED indicators 52 and 58, thereby to indicate which drink and which quantity have been selected.

The processor 62 has an associated memory device 76 for storing as required 'drink' and 'quantity' selections and other data, and an associated clock 78 for providing the sequence of timing signals necessary for the operation of the processor itself, for timing the flows of the respective fluids through the respective control valves of the nozzles 16, and for providing dates and times of the various drink dispensing operations that have been effected.

The processor 62 is also provided with an input/output means 80 for enabling it to relay, by an infra-red link 84, drink dispensing data held temporarily in the processor 62 and memory 76 to a data collection unit 82.

The data collection unit 82 is electrically connectible with a lap-top computer 86 which includes a monitor 88 for displaying data received from the data collection unit 82, and a keyboard 90 for inputting information (e.g. relating to customer identity) to the system via the data collection unit 32 and the infra-red link 84.

The processor 62 has a second input/output means 92 for enabling it to communicate via a master/slave serial communication system with remotely situated syrup supply monitors 94 which have separate monitoring elements for monitoring respectively three separate functions: (a) the presence/absence of syrup in the supply lines 24(B,C,D) leading from the respective syrup boxes 36–40 to the control valves 26(B,C,D), (b) the integrity of those syrup-supply lines, and (c) the quality of the syrups flowing in those supply lines.

The functions (a) and (b) may be monitored, for example, by observing pressure changes in the syrup lines, whilst the function (c) may be monitored, for example, by observing the contents of those lines by optical monitoring means or by acoustic monitoring means thereby to determine the characteristics of the syrup being used.

Loss of syrup supply either by the emptying of a syrup box or by the unauthorised disconnection of a syrup box (or the syrup supply line at some other point) results in the emission by the monitoring means of an 'syrup failure' signal to the micro-processor. Such a signal accompanying a 'drink type' signal or a 'drink quantity' signal from the keys 48 or 50 results in the emission of an 'inhibit' signal to negate, in a drinks management system, the adding of a drink count to the total count of drinks already dispensed. Thus, dispensing only carbonated water in response to a selection of a drink type which requires the addition of syrup would not increase the total count of drinks dispensed. This ensures that the 'drinks dispensed' information supplied to the management system is accurate.

Furthermore, the emission of such an inhibit signal may be used to inhibit a 'drinks' cost reckoning being made in an adjacent electronic-point-of-sales (EPOS) till in response to such 'drink type' and 'drink quantity' signals.

The emission of a 'syrup failure' signal also gives warning of the need to substitute a new syrup box for an empty one, and where appropriate to initiate an automatic changeover to a new syrup box.

The emission of a 'supply line tampered' signal by the monitoring means gives warning that the syrup supply lines have been disconnected or otherwise tampered with, possibly by an unauthorised person.

The emission of a 'quality failure' signal by the monitoring means occurs when the quality of the monitored syrup fails to meet the required standard, and indicates the possibility that a competitor's syrups are being used instead of the authorised ones. Such 'supply line tampered' and 'quality failure' signals have the same effect as the 'syrup failure' signals, in producing 'inhibit' signals for preventing the improper recording of a dispensed drink in the management system or in an 'EPOS' till In operation, the processor 62 receives (a) from the 'drink' selection keys 48—'drink' selection signals emitted by those keys on being touched, and (b) from the 'quantity' selection keys 50—'quantity' selection signals emitted by those keys on being touched, and translates each pair of associated 'drink' and 'quantity' selection signals into control signals for the relevant pair of 'carbonated water' and 'syrup' control valves 22 and 26, thereby to deliver at the relevant nozzle 16 the selected drink in the selected quantity.

On receipt of an associated pair of 'drink' and 'quantity' signals, the processor immediately energises the relevant pair of nozzle control valves thereby to commence delivery of the selected drink without any delay. Hence, after keying in the first drink selections, delivery of that drink proceeds whilst the subsequent selections are keyed in. Thus, delivery from the respective nozzles commences in a serial manner and continues in an over-lapping manner. This permits a continuous process of drinks dispensing, since immediately the first drink is dispensed, that drink may be removed and be replaced by another glass, whereupon the selections for the drink to be delivered to that new glass can be made, and so on, and likewise at the respective other dispensing nozzles 16.

In response to a customer's order for carbonated water, the processor energises in response to that keyed-in selection only the carbonated water control valve 22A of the nozzle 16A, thereby to allow the flow of only carbonated water through that nozzle, the associated syrup valve 26A remaining closed against the flow of lemonade syrup.

The processor 62 is arranged to record in the associated memory 76 the details of all the drink transactions carried out in response to operation of the selection keys, and to deliver those details to the data collection unit 82 when that device emits an infra-red command signal calling for the transmission of those details to it. The data collection unit 82 can then input that information subsequently to the lap-top computer 86 for use in a drinks management system, and/or display on the monitor 88.

Data (for example, relating to the location of the unit, the customer, the syrups, or to the sizes of the cups/glasses to be used) can be inputted to the processor 62 and memory 76. That data is first introduced into the system by means of the keyboard 90, and is subsequently transferred to the data collection unit 82 for onward transmission to the processor 62 and memory 76 by the infra-red signal link 84.

With the present drinks-dispensing unit, the selections are all made quite quickly at the one keypad, regardless of which drinks are required. Moreover, the dispensing of successive drinks takes place in the minimum of time, so that customers' multiple-drink orders are fulfilled with the minimum of delay and in the minimum of time.

In the TEACH mode, the processor and memory are taught by example the dispensing cycle to be used for each dispensing head for each of the selected drink quantities, that is, for each pair of associated 'drink type' and 'drink quantity' selection signals that may be keyed in. This is achieved, when in the TEACH mode, by executing for each dispensing head with each of the selected drink quantities a manually controlled dispensing cycle for that combination. The data defining each such cycle is stored in the memory, and is used each time the same combination of 'drink type' and associated 'drink quantity' signals is keyed in on the keypad.

An alternative entry to the TEACH mode may be made by keying in on one only of the two groups of keys 48 or 50 a predetermined sequence of key operations.

Whereas the monitors 94 are shown adjacent the syrup supply boxes 36–40, they may be alternatively positioned on the output side of the pumps 30, or according to circumstances at any other suitable position on the syrup supply lines where the desired monitoring action can be satisfactorily obtained.

If desired, the monitoring means 94 may also supply syrup pressure signals to the processor 62, thereby to enable the processor to adjust in a corrective manner the respective times to be used in dispensing the respective sizes of drinks keyed in on keys 50.

Alternatively, (or in addition) such syrup pressure signals may be used to modify the output pressures of the respective pumps in a corrective sense and so maintain the desired rates of flow.

The data collection unit 82 is preferably a small hand-held, battery-operated device, and is programmed to store in its own non-volatile memory data received from the processor 62 and memory 76. That non-volatile memory is capable of storing data from as many as thirty-two multi-head drinks dispensing units 10. The data collection unit may also include a battery-backed real time clock, which may be used if desired to set the time on the clock 73 of the drinks-dispensing unit 10. The data collection unit preferably has a READ key for initiating the storage in its own memory of data stored in the processor 62 and memory 76 of the dispensing unit 10, and a RESET key for clearing such data from the processor 62 and memory 76 after it has been transferred to the data collection unit's memory.

The electrical control and monitoring system described above may be applied as retro-fit equipment to any suitable existing multi-head drinks-dispensing apparatus.

It should be noted that in the drawing the arrow heads indicate the directions of the various fluid and electric signal flows.

I claim:

1. Multihead drinks dispensing apparatus comprising a plurality of spaced locations each arranged to receive a respective cup, a drinks dispensing head at each location for dispensing drink into the cup, each head including (i) a nozzle for supplying ingredients different to the ingredients supplied by any other head and (ii) associated control valve means for controlling the flow of drink ingredients under pressure from ingredient supply means to the nozzle for mixing there and delivery into the waiting cup, a common control array for said heads, said control array including (a) first selection means for selecting a drink to be dispensed and thus the dispensing head to be used, (b) a second selection means for selecting the quantity of drink to be delivered irrespective of which head is selected, said first and second selection means being arranged, when operated in association, to emit respective first and second selection signals representative of the selected drink and selected quantity of the selected drink, (c) memory means for storing at least temporarily each pair of associated first and second selection signals, and (d) logic circuit means arranged to receive said pairs of associated first and second selection signals and in response to each such pair of signals to provide a valve control signal for effecting energisation of the control valve means of the selected dispensing head for a period sufficient to deliver the selected quantity of the selected drink, whereby by operating the first and second selection means to produce two or more pairs of first and second selection signals in quick succession two or more drinks may be dispensed simultaneously at different said locations in a serial but over-lapping time relationship.

2. Multihead drinks dispensing apparatus according to claim 1, wherein supply means for supplying the respective drink ingredients to the respective control valve means are arranged to supply those ingredients at predetermined constant flow rates, and wherein the logic circuit in response to a said second selection signal determines the time period during which the relevant control valve means shall be energised and deliver the relevant drink ingredients to the associated nozzle.

3. Multihead drinks dispensing apparatus according to claim 1 or 2, wherein there is provided in at least one supply line extending between a drink ingredient supply means and the associated control valve means a monitoring means for monitoring the presence of a drink ingredient in that supply line, the monitoring means being arranged to emit an ingredient failure warning signal when there is insufficient drink ingredient in the monitored supply line.

4. Multihead drinks dispensing apparatus according to claim 1 or 2, wherein there is provided in at least one supply line extending between a drink ingredient supply means and the associated control valve means a supply line monitoring means for monitoring the integrity of that supply line, the monitoring means being arranged to emit a supply line tampered warning signal when that supply line has been interrupted, or otherwise tampered with.

5. Multihead drinks dispensing apparatus according to claim 1 or 2, wherein there is provided in at least one supply line extending between a drink ingredient supply means and the associated control valve means a monitoring means for monitoring the quality of a drink ingredient in that supply line, the monitoring means being arranged to emit quality failure warning signal when the quality of the ingredient in the monitored supply line falls below a required standard.

6. Multihead drinks dispensing apparatus according to claim 3, including means responsive to said first selection signals and to said ingredient failure warning signals, and to emit an inhibit signal whenever a first selection signal and an ingredient failure signal are present simultaneously.

7. Multihead drinks dispensing apparatus according to claim 4, including means responsive to said first selection signals and to said supply line tampered warning signals, and to emit an inhibit signal whenever a first selection signal and a supply line tampered signal are present simultaneously.

8. Multihead drinks dispensing apparatus according to claim 5, including means responsive to said first selection signals and to said quality failure warning signals, and to emit an inhibit signal whenever a first selection signal and a quality failure signal are present simultaneously.

9. Multihead drinks dispensing apparatus according to claim 6, wherein said memory means retains in storage each such pair of associated first and second selection signals, and stores in association therewith any such inhibit signal emitted pursuant to that pair of selection signals, thereby to indicate that there has been a failure to properly dispense a selected drink.

10. Multihead drinks dispersing apparatus according to claim 9, including means for totalling the selected drinks in response to the emission of each such first selection signal, and wherein the total is not increased in response to a first selection signal when that signal is accompanied by an inhibit signal.

11. Multihead drinks dispensing apparatus according to claim 9, including means for totalling the selected drinks in response to the emission of each such second selection signal, and wherein the total is not increased in response to a second selection signal when that signal is accompanied by an inhibit signal.

12. Multihead drinks dispensing apparatus according to claim 1, including a timing device for recording the day and/or time at which a drink has been selected.

13. Multihead drinks dispensing apparatus according to claim 1, wherein the logic circuit means comprises a suitably programmed microprocessor.

* * * * *